US008156721B1

(12) United States Patent
Epstein

(10) Patent No.: US 8,156,721 B1
(45) Date of Patent: Apr. 17, 2012

(54) TRANSPORT CHAIN FOR FORM-FILL PACKAGING APPARATUS

(76) Inventor: Moshe Epstein, Northbrook, IL (US)

( * ) Notice: Subject to any disclaimer, the term of this patent is extended or adjusted under 35 U.S.C. 154(b) by 372 days.

(21) Appl. No.: 12/506,396

(22) Filed: Jul. 21, 2009

(51) Int. Cl.
*B65G 17/30* (2006.01)

(52) U.S. Cl. ..... 53/559; 53/563; 53/574; 464/49; 245/4

(58) Field of Classification Search ..... 53/559, 53/563, 574; D08/499; 464/49; 245/4; 428/558; 75/243, 558, 574
See application file for complete search history.

(56) References Cited

U.S. PATENT DOCUMENTS

| | | | | | |
|---|---|---|---|---|---|
| 3,326,647 | A | * | 6/1967 | Holtzman | 428/682 |
| 3,547,625 | A | * | 12/1970 | Bieber et al. | 420/38 |
| 3,900,316 | A | * | 8/1975 | Jones | 420/42 |
| 4,007,038 | A | * | 2/1977 | Deverell | 420/40 |
| 4,078,920 | A | * | 3/1978 | Liljas et al. | 420/40 |
| 4,329,173 | A | * | 5/1982 | Culling | 420/38 |
| 4,439,498 | A | * | 3/1984 | Sadowski | 428/558 |
| 4,545,826 | A | * | 10/1985 | McCunn et al. | 148/542 |
| 4,897,985 | A | | 2/1990 | Buchko et al. | |
| 4,951,444 | A | | 8/1990 | Epstein | |
| 5,172,854 | A | | 12/1992 | Epstein | |
| 5,234,302 | A | * | 8/1993 | Gawve et al. | 414/157 |
| 5,271,207 | A | | 12/1993 | Epstein | |
| 5,517,805 | A | | 5/1996 | Epstein | |
| 6,443,828 | B1 | | 9/2002 | Melville | |
| 6,707,014 | B1 | * | 3/2004 | Corey et al. | 219/494 |
| 7,343,730 | B2 | * | 3/2008 | Humcke et al. | 59/78 |
| D575,660 | S | * | 8/2008 | Maier | D11/13 |
| 2007/0107412 | A1 | * | 5/2007 | Humcke et al. | 59/1 |
| 2009/0208892 | A1 | * | 8/2009 | Kozman et al. | 432/146 |

* cited by examiner

*Primary Examiner* — Hemant M Desai
(74) *Attorney, Agent, or Firm* — Milton S. Gerstein

(57) ABSTRACT

A transport indexing chain for a food-packaging machine is made of two different materials in order to provide the most optimal result of a drive chain that resists wear and tear and thus reduces elongation of the chain over time, and which also provides a drive indexing chain that resists bacterial infection. In order to satisfy the first objective of providing a chain that resists wear and elongation of the drive chain, the parts thereof that remain exposed to greasing or lubrication, and thus are resistant to rusting, are made of the same prior-art material of nickel-plated carbon steel. These parts are: The bushings, the rollers, and the pivot rods or pins. The remaining parts, namely the links or side plates and the clamping attachments, are made of stainless steel, whereby prevention of bacterial infection is substantially achieved without increased wear.

13 Claims, 2 Drawing Sheets

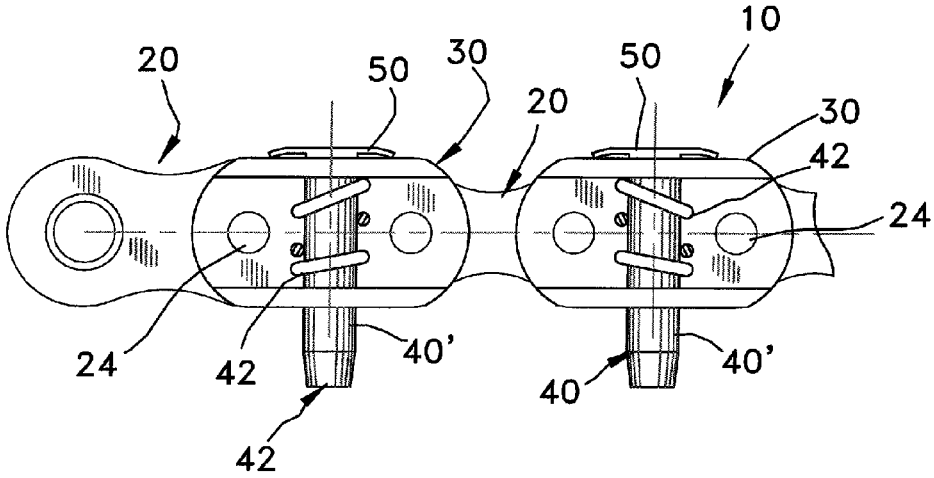
.315 FIG 1
PRIOR ART
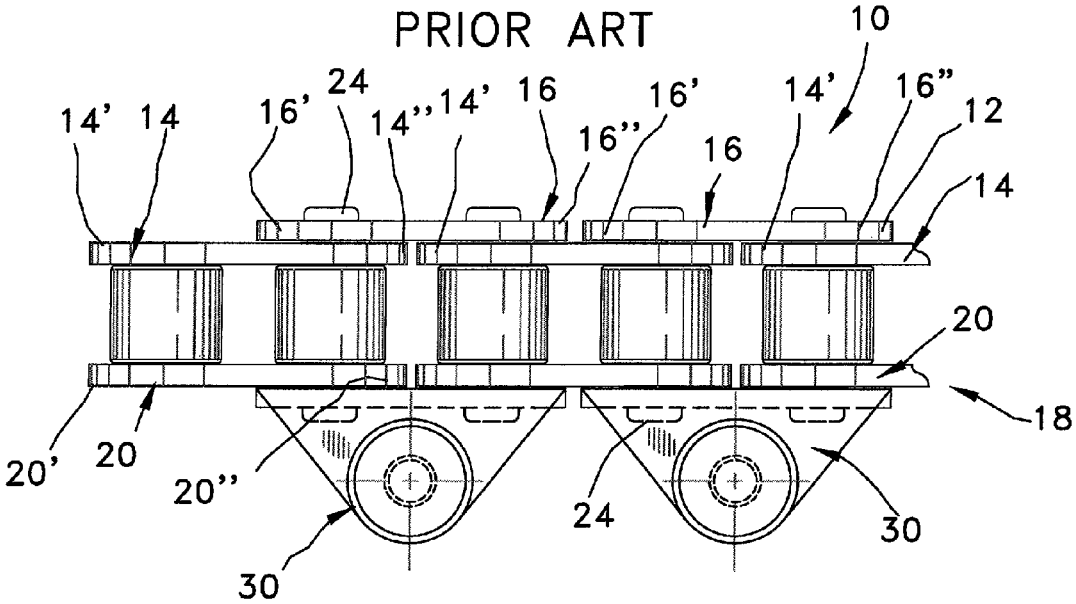
FIG 2
PRIOR ART

TRANSPORT CHAIN FOR FORM-FILL PACKAGING APPARATUS

BACKGROUND OF THE INVENTION

The present invention is directed to an improvement in a transport drive or indexing chain used in an indexing, vacuum-packaging machine. Examples of such conventional vacuum packaging machines with transport chains are disclosed in applicant's U.S. Pat. Nos. 4,951,444, 5,271,207 and 5,517,805, for example, which references are incorporated by reference herein. The invention has especial relevance to vacuum-packaging apparatuses, such as those manufactured by "TIROMAT".

In a conventional, indexing vacuum-packaging machine, a lower or bottom film or film-web is indexed using an indexing advancing mechanism for situating the lower film at a forming station for forming transverse, multiple package-receptacles formed therein, and then to a sealing or sealing/vacuum station, where the upper film for completing the packages is applied, and vacuum-sealed. At each station, a lower tool is raised toward an upper, stationary tool for performing the requisite tasks at the respective station. The lower or bottom film, in which are formed a plurality of formed receptacles or packages, is indexed every cycle using an indexing or transport drive mechanism incorporating a pair of laterally-opposite, parallelly-arranged drive or indexing chains on either lateral side of the packaging machine. Each chain is made up of a series of pivotally-connected links or side plates, a series of bushings, a series of pivot rods mounted in the bushings which pivotally connect together the ends of the links or side plates, and a series of rollers also rotatably mounted by the series of the pivot pins, and a series of attachments each mounting a biased, retractable engaging pin-detent for engaging with perforations side-edges of the bottom film for translating the bottom film during every film cycle.

Hitherofore, all of the above-mentioned elements of each drive-chain have been made of nickel-plated carbon steel, and is typically a number 10 metric chain. The reason for this is in order to provide a strong, hard chain that wears very little over time. For example, if the pivot rods were to wear just 1/1000 inch, and assuming there are 1000 links along the length of the chain, then the chain will have stretched a total of one inch, which would cause misalignment of the film registration during the film-indexing cycles, which would thus necessitate continual re-alignment of the machine, which would thus cause downtime and loss of output.

There have been in the recent past numerous cases of bacterial infestation or contamination of food-processing and food-packaging machines and apparatuses, especially those associated with the listeria bacteria. It has been found the most common place where these bacterial infections start and grow is in the transport indexing chains. When such a machine or plant becomes infected with listeria, it is very difficult to clean, and causing large losses. In one attempt to solve this problem, entire chains, including all of the above-enumerated parts thereof, have been made of stainless steel, which is more resistant to listeria, or other bacterial, infection. However, since stainless steel is considerably inferior in overall wear in comparison to nickel-plated carbon steel, the above-mentioned wear of the pivot rods has occurred, along with the concomitant elongation of the indexing chain and concomitant misalignment or mis-registration of the bottom film at the various stations of the packaging machine.

The present invention has solved these interdependent problems by firstly noting that the locations along an indexing chain that are most likely to be receptive to bacterial infection are those areas that tend to rust, and, secondly, by noticing that those areas of the indexing chain that maintain adequate greasing or lubrication do not tend to rust.

SUMMARY OF THE INVENTION

It is the primary objective of the present invention to provide an improved indexing packaging machine with an indexing chain that maintains the high-standard of resisting wear in order to prevent the concomitant misalignment factors associated therewith, and which also considerably reduces or eliminates bacterial infection of the indexing drive chain.

Toward these and other ends, each transport indexing chain of a food-packaging machine is made of two different materials in order to provide the most optimal result of a drive chain that resists wear and tear and thus reduces elongation of the chain over time, and which also provides a drive indexing chain that resists bacterial infection. In order to satisfy the first objective of providing a chain that resists wear and elongation of the drive chain, the parts thereof that remain exposed to grease or lubrication, and thus are resistant to rusting, will be made of the same prior-art material of nickel-plated carbon steel. These parts are: The bushings, the rollers, and the pivot rods or pins. The remaining parts, namely the links, or side plates, and the gripper attachments, are made of stainless steel. Thus, the novel chain not only prevents excessive wear but also prevents bacterial infection.

BRIEF DESCRIPTION OF THE DRAWINGS

The invention will be more readily understood with reference to the accompanying drawings, wherein:

FIG. 1 is a side elevated view of a conventional transport indexing chain used in a multi, vacuum-packaging machine;

FIG. 2 is a tope view thereof; and

DETAILED DESCRIPTION OF THE INVENTION

Figure 3:
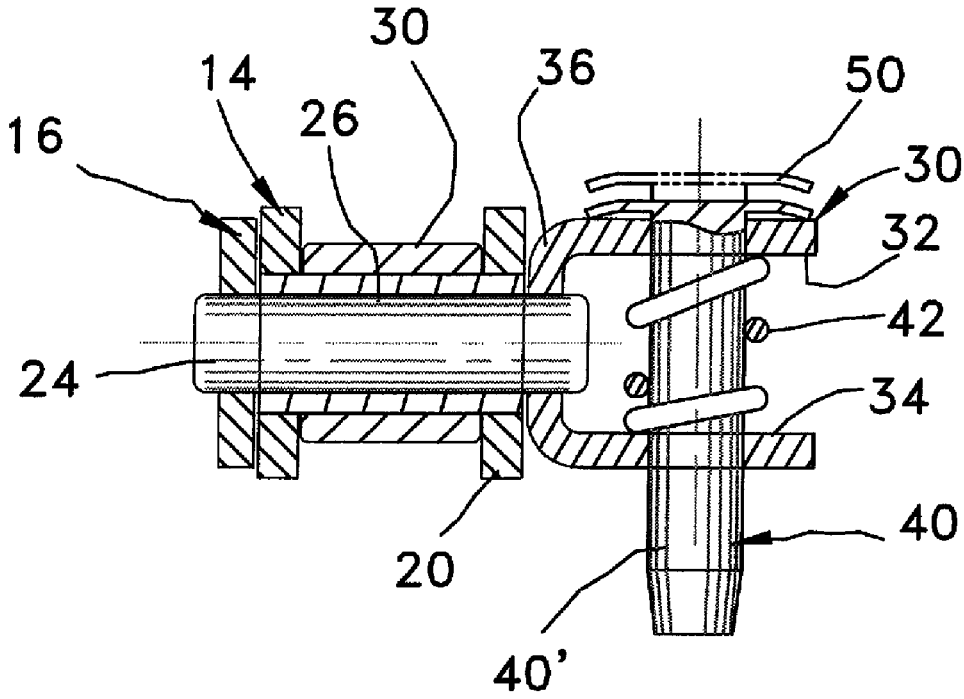
FIG 3 PRIOR ART
FIG. 3 is a detailed side cross-sectional view of one gripper attachment of a series of gripper attachments secured to the interconnected links of the transport indexing chain of FIG. 1.

Referring now to the drawings in greater detail, there is shown in FIGS. 1-3, a conventional, endless, transport indexing chain of a conventional vacuum packaging machine, such as that disclosed in U.S. Pat. Nos. 4,951,444, 5,271,207 and 5,517,805, which references are incorporated by reference herein, it being understood that two such endless, transport indexing chains are provided on the two lateral side of the packaging-machine frame. Each endless, indexing transport chain 10 consists of a first lateral series 12 of pivotally-interconnected, hour-glass or bar-bell shaped links or side plates. The first series 12 of links or side plates consists of an alternating pattern of inner and outer links or side plates 14, 16, respectively. Each inner link consists of a first end section 14' and a second end section 14", while each outer link 16 consists of a first end section 16' and a second end section 16". Each outer link overlaps two inner links such that a respective end section 16' overlaps and is coextensive with a respective end section 14" of a first link, and respective end section 16" overlaps and is coextensive with a respective end section 14' of a different first link. The chain 10 also consists of a second lateral and parallel series 18 of pivotally-interconnected, hour-glass or bar-bell shaped links or side plates 20, each link 20 defining a first end section 20' and a second end section 20". Each of the end sections 14', 14", 16', 16", 20', 20" is provided with a through hole or opening for receiving a pivot pin or rod 24, whereby end each pivot pin pivotally mounts and connects respective end sections of the links 12, 14 and 20. The end sections 14', 14" of the inner links 14, along with the corresponding and respective end sections 20', 20" of the links 20 mount therebetween bushings or sleeves 26 about which are respectively rotatably mounted rollers 30', whereby the indexing chain rolls along the side walls of the packaging machine during the indexing thereof.

The transport chain 10 is also provided with a series of plate or bracket attachments 30 each of which is mounted between adjoining ends of two links 20 of the second series of links 18. Each attachment 30 is a U-shaped bracket defining a pair of upper and lower legs or walls 32, 34, and a joining side wall 36. The side wall 36 is provided with a pair of spaced-apart holes through which are received respective ones of the pivot pins 24 for fixedly mounting each attachment 30 between two second-series links 20; that is, one hole of the side wall receives a pivot pin 24 connected to an end section 20' of one of the links 20 of the second series 18, while the other hole of the same attachment receives a different pivot pin 24 connected to an end section 20" of another, different link 20 of the second series of links 18. The upper and lower walls 32, 34 are provided with aligned holes for passing therethrough a clamping pin 40.

The plate or bracket attachments 30 are grippers or gripper attachments, with the engaging or clamping pin 40 being biased downwardly by a compression spring 42. The compression spring telescopingly surrounds the shaft 40' of the clamping pin. The spring telescopingly surrounds the shaft 40' of the clamping pin, with the shaft 42 having a lower peripheral or annular recess or cutout section in which one end of the spring 42 is mounted, whereby the clamping pin 40 is normally biased in a downward direction for engagement with the edge of a bottom film layer being indexed for indexing the film from one station to another, as best seen in FIG. 3. The head or button 50 of the clamping pin is engageable by a cam at the end of the last stage of the indexing cycle to lift the pin out of engagement with the bottom film in order to release it after complete package-formation. There is also provided a cup-washer (not shown) against which a portion of the spring 42 abuts, which cup-washer is concentrically mounted about the shaft 40' and in contact against the juxta-positioned lower or bottom wall of the U-shaped attachment 30.

Whereas in the prior art all, all components—except for the pins 40, the springs 42, and the cup-washers which have been made of stainless steel—have been made of nickel-plated carbon steel, the endless chain in accordance with the invention, utilizes different materials for different sections of each indexing chain. All of the bushings 26, rollers 30', and pivot pins 24 are made of nickel-plated carbon steel, as in presently-used, conventional indexing chains. However, all of the links or side plates 14, 16 and 20, and the bracket attachments 30 are made from 300 series stainless steel. The 300 series stainless are austenitic grades alloys which are not magnetic and are iron-chromium steels. The austenitic stainless steels, because of their high chromium, are the most corrosion resistant of the stainless group providing unusually fine mechanical properties. Stainless steels have sufficient amounts of chromium present so that a passive film of chromium oxide forms which prevents further surface corrosion and blocks corrosion from spreading into the metal's internal structure. This property of being corrosion-resistant is what makes the 300 series stainless steel best suited for the present invention, since, as mentioned above, it is corrosion and rust that harbour and breed bacterial, such as lysteria, in food packaging machines. In order to provide the greatest corrosion and rust resistance, "L" grades of stainless steel are preferably used in the present invention, since "L" grades have low carbon content. The carbon is typically kept to 0.03% or under in order to avoid carbide precipitation. In particular, 303 or 304L stainless steel is preferably used. Also, other stainless steel such as 317L, 317LM, and 317LMN types of the 300 series of stainless steel may be used, although they are more costly, with the 317LM containing molybdenum of approximately 4.0% minimum ("M" in 317LM), while the 317LMN, in addition to containing 4.0% molybdenum, also contains 0.15% nitrogen, both of which add additional corrosion and rust resistance and protection.

The parts of the chain made of stainless steel are those that are least exposed to lubrication and therefore tend to rust at a faster rate. Those parts of the chain needed for strength and hardness remain made of nickel-plated carbon steel, and preferably are number 10 nickel-plated, carbon steel chains, since those are the parts exposed to lubrication and, thus, least likely to exhibit rusting, and which also require the greatest amount of hardness and strength. Since rusting is greatly, if not entirely, reduced using the materials above described, bacterial infection is substantially prevented.

The present invention may be used in all types of food packaging machines, in addition to vacuum-packaging apparatuses, it being understood that the types, formation and shapes of the links and gripper attachments, or attachments, may be changed, altered or modified, as long as the non-lubricated parts of the transport chain are made of 300 series stainless steel, with the remaining parts of the chain being made of nickel-plated carbon steel.

While a specific embodiment of the invention has been shown and described, it is to be understood that numerous changes and modifications may be made therein without departing from the scope and spirit of the invention.

What is claimed is:

1. In a food packaging machine comprising a main frame, at least one work station for forming at least one package-receptacle in a bottom film located thereat, and at least one transport indexing chain for advancing the bottom lower film to and from said at least one work station, said transport indexing chain comprising a series of interconnected links, lubricated pivot pins for pivotally mounting together adjacent said links, a series of lubricated bushings mounted by said series of links, a series of lubricated rollers rotatable about said pivot pins and mounted in said series of bushings, and a series of gripper attachments securely connected to said series of links, each said gripper attachment comprising a bracket element secured to at least one said link, the improvement comprising:

each said link of said series of links and each said bracket element of said series of gripper attachments being made of 300 series stainless steel;

said pivot pins, each said bushing of said series of bushing, and each said roller of said series of rollers being made of nickel-plated carbon steel, whereby non-lubricated parts of the transport indexing chain are made of rust-resistant and corrosion-resistant material in order to prevent bacterial growth.

2. The food packaging machine according to claim 1, wherein said 300 series of stainless steel is chosen from one of the group consisting of: 303, 304L 317L, 317LM, and 317LMN types of the 300 series of stainless steel.

3. The food packaging machine according to claim 1, wherein said 300 series of stainless steel is one of the 303 and 304L type.

4. The food packaging machine according to claim 1, wherein said 300 series of stainless steel is one of the 303 and 304L.

5. The food packaging machine according to claim 1, wherein said 300 series of stainless steel is one of the 303 and 304L type.

6. In a food packaging machine comprising a main frame, at least one work station for forming at least one package-receptacle in the bottom film, and at least one transport indexing chain for advancing the bottom film to and from said at least one work station; said transport indexing chain comprising a first lateral series of interconnected side plates having first inner ones of side plates and second outer ones of said side plates, said first inner side plates and said second outer side plates forming an alternating interconnected pattern where an outer said side plate is connected to two said inner side plates at end sections thereof; said transport indexing chain further comprising a second lateral series of interconnected side plates mounted parallel to said first lateral series of interconnected side plates; a series of lubricated pivot pins for pivotally mounting together adjacent said inner and outer side plates of said first lateral series and said side plates of said second lateral series of side plates; a series of lubricated bushings mounted by said first and second lateral series of side plates; a series of lubricated rollers rotatable about said series of pivot pins and mounted in said series of bushings; and a series of gripper attachments securely connected to said side plates of said second lateral series of side plates, each said gripper attachment comprising a bracket element secured to two adjacent ones of said side plates of said second lateral series of side plates, the improvement comprising:

each said side plate of each of said first and second lateral series of side plates, and each said bracket element of said series of gripper attachments being made of stainless steel;

each said pivot pin of said series of pivot pins, each said bushing of said series of bushing, and each said roller of said series of rollers being made of nickel-plated carbon steel, whereby non-lubricated parts of the transport indexing chain are made of rust-resistant and corrosion-resistant material in order to prevent bacterial growth.

7. The food packaging machine according to claim 6, wherein said stainless steel is chosen from one of the group consisting of: 303, 304L, 317L, 317LM, and 317LMN types of the 300 series of stainless steel.

8. The food packaging machine according to claim 6, wherein said stainless steel is one of the 303 and 304L type.

9. The food packaging machine according to claim 6, wherein said stainless steel is one of the 303 and 304L type.

10. The food packaging machine according to claim 6, wherein said stainless steel is the 303 and 304L type.

11. In a transport indexing chain for use in a food packaging machine for advancing the bottom film used in the food packaging machine to and from at least one work station, said transport indexing chain comprising a first lateral series of interconnected side plates having first inner ones of side plates and second outer ones of said side plates, said first inner side plates and said second side plates forming an alternating interconnected pattern where an outer said side plate is connected to two said inner side plates at end sections thereof; said transport indexing chain also comprising, a second lateral series of interconnected side plates mounted parallel to said first lateral series of interconnected side plates; a series of lubricated pivot pins for pivotally mounting together adjacent said inner and outer side plates of said first lateral series and said side plates of said second lateral series of side plates; a series of lubricated bushings mounted by said first and second lateral series of side plates; a series of lubricated rollers rotatable about said series of pivot pins and mounted in said series of bushings; and a series of gripper attachments securely connected to said side plates of said second lateral series of side plates, each said gripper attachment comprising a bracket element secured to two adjacent ones of said side plates of said second lateral series of side plates, the improvement comprising:

each said side plate of each of said first and second lateral series of side plates, and each said bracket element of said series of gripper attachments being made of stainless steel;

each said pivot pin of said series of pivot pins, each said bushing of said series of bushing, and each said roller of said series of rollers being made of nickel-plated carbon steel, whereby non-lubricated parts of the transport indexing chain are made of rust-resistant and corrosion-resistant material in order to prevent bacterial growth.

12. The food packaging machine according to claim 11, wherein said stainless steel is chosen from one of the group consisting of: 303, 304L, 317L, 317LM, and 317LMN types of the 300 series of stainless steel.

13. The food packaging machine according to claim 11, wherein said stainless steel is chosen from 300 series of stainless steel.

* * * * *